US010253680B2

(12) United States Patent
Clark

(10) Patent No.: US 10,253,680 B2
(45) Date of Patent: Apr. 9, 2019

(54) INTERNAL COMBUSTION ENGINE HAVING FUEL/AIR INDUCTION SYSTEM

(71) Applicant: Roland Clark, Huntington Beach, CA (US)

(72) Inventor: Roland Clark, Huntington Beach, CA (US)

( * ) Notice: Subject to any disclaimer, the term of this patent is extended or adjusted under 35 U.S.C. 154(b) by 0 days.

(21) Appl. No.: 15/433,955

(22) Filed: Feb. 15, 2017

(65) Prior Publication Data

US 2018/0230897 A1 Aug. 16, 2018

(51) Int. Cl.
*F02B 75/20* (2006.01)
*F02B 33/22* (2006.01)

(52) U.S. Cl.
CPC ..... *F02B 33/22* (2013.01)

(58) Field of Classification Search
CPC ..... F02B 33/22; F02B 33/44
USPC ..... 123/52.2, 70 R
See application file for complete search history.

(56) References Cited

U.S. PATENT DOCUMENTS 3,675,630 A * 7/1972 Stratton ..... F01L 9/04 123/70 R
4,357,916 A * 11/1982 Noguchi ..... F01B 7/14 123/51 BA
4,506,634 A * 3/1985 Kerrebrock ..... F02B 33/22 123/52.3
6,467,440 B1 * 10/2002 Kozulin ..... F02B 33/10 123/51 B
2003/0015171 A1 * 1/2003 Scuderi ..... F02B 33/22 123/316
2004/0154560 A1 * 8/2004 Isogai ..... F02B 33/22 123/55.5
2004/0255882 A1 * 12/2004 Branyon ..... F02B 33/22 123/70 R
2005/0016475 A1 * 1/2005 Scuderi ..... F02B 33/22 123/70 R
2007/0157894 A1 * 7/2007 Scuderi ..... F02B 21/00 123/70 R
2008/0202454 A1 * 8/2008 Pirault ..... F02B 33/22 123/58.8

* cited by examiner

*Primary Examiner* — Hung Q Nguyen
(74) *Attorney, Agent, or Firm* — Roy A. Ekstrand

(57) ABSTRACT

An internal combustion engine having a fuel/air induction system having a crankshaft-driven compression piston that is reciprocated within a fuel/air compression cylinder in a cooperative operation which fills a combustion cylinder with a quantity of fuel/air mixture under pressure during each engine cycle. A combustion piston within the combustion cylinder is reciprocated by the engine crankshaft to further compress the fuel/air mixture charge and harness the power of the ignited mixture.

2 Claims, 13 Drawing Sheets

INTERNAL COMBUSTION ENGINE HAVING FUEL/AIR INDUCTION SYSTEM

FIELD OF THE INVENTION

This invention relates generally to internal combustion engines and particularly to the apparatus utilized in supplying the fuel/air mixture to the cylinder combustion chambers of the engine.

BACKGROUND OF THE INVENTION

The basic internal combustion engine has proven to be a reliable, flexible and highly effective source of power in a great number of applications and industries. Internal combustion engines have been applied to very small portable applications such as handheld and equipment as well as to large commercial or industrial environments such as manufacturing facilities, power and utility companies and to a virtually endless variety of vehicles. While the design and fabrication of internal combustion engines has varied substantially over time to meet different application requirements, the basic internal combustion engine is relatively simple and direct. Internal combustion engines generally include one or more cylinders within which a piston is moved in a reciprocating motion profile under the direct drive of a connecting rod and crankshaft. The crankshaft is rotationally supported by the engine block and provides eccentric couplings for the piston connecting rods. A system of valves controls the introduction of a fuel/air mixture into the combustion chambers of the cylinders and a source of ignition, such as a spark plug or the like, ignites the compressed fuel/air mixture and the fuel burns driving the piston through its power stroke. The power stroke of the piston causes rotation of the crankshaft and rotational power, or torque is produced.

Generally speaking, internal combustion engines may be divided into two cycle and four cycle engines. Two cycle engines, also referred to as "two-stroke engines", acquired their name based upon the operational characteristic by which the reciprocating piston is moved through two strokes, or movements, during each engine cycle. The first stroke occurs following fuel ignition in which the piston moves downwardly in a power/exhaust stroke. The second stroke occurs as the piston moves upwardly in a intake/compression stroke. Thus, a charge of compressed fuel/air mixture is ignited and burned and thereafter exhausted from the engine during each rotation of the crankshaft.

Conversely, four cycle engines, also referred to as "four-stroke engines", acquired their name based upon piston movement through four piston strokes during each operational cycle. Accordingly, each piston in a four stroke internal combustion engine moves downwardly through an intake stroke, drawing fuel/air into the cylinder and upwardly through a compression stroke in which the fuel/air mixture is compressed. Once the fuel/air mixture is compressed, it ignition takes place and the piston moves downwardly through a power stroke. Finally, the piston moves upwardly through an exhaust stroke in which burned gases are exhausted from the cylinder. In a four stroke engine the crankshaft is rotated twice for each engine cycle.

For both two-stroke and four stroke internal combustion engines, practitioners in the art have endeavored to increase the power output and fuel efficiency of the engines. Efforts to provide such improvements have typically involved systems for increasing the amount of fuel/air mixture is injected or drawn into the combustion chambers of the engines.

These efforts have included reason according to external apparatus such as blowers, superchargers and turbochargers which essentially comprise air pumps or compressors that force air or fuel/air mixture into the combustion chambers of the engines under great pressure. Blowers typically provide air pumps, or compressors, driving pressurized air into the engine carburetors. The power to operate the blowers is provided by a system of engine-driven belts, pulleys and/or gears driven by the engine crankshaft.

Superchargers, on the other hand, typically involve compressors or air pumps which compress a fuel/air mixture that is driven into the engine intake manifold. In similarity to blowers, superchargers also derive power from a system of engine-driven belts, pulleys and/or gears driven by the engine crankshaft.

Turbochargers provide air pumps or compressors deriving their power from a turbine energized by the flow of exhaust gases from the engine. Thus, turbochargers are in essence exhaust-driven blowers.

Unfortunately, blowers, superchargers and turbochargers have proven to be prohibitively expensive and complex in their structure and operation. When used in vehicles, they often require extensive additional within the engine compartment of the vehicle. Additional problems arise in the operation of such vehicles which may complicate throttle and control systems of the host vehicle. Throttle response is often compromised by such devices. One of the more vexing problems encountered in such devices is known generally in the art as "throttle lag" characterized by a "pause or dead spot" in engine response to throttle action. Such devices also may be found to reduce the fuel efficiency of the engine.

In the face of the continuing need to provide evermore improved internal combustion engine performance practitioners in the art have applied a variety of technologies. For example, U.S. Pat. No. 5,220,899 issued to Ikebe et al, sets forth an INTERNAL COMBUSTION ENGINE WITH AIR ASSIST FUEL INJECTION CONTROL SYSTEM in which an internal combustion engine of the type having a fuel injection valve is provided with an assist air supply device for finely atomizing fuel includes a swirl control device for producing a swirl in the combustion chamber of the engine.

U.S. Pat. No. 7,252,076 issued to Cho sets forth an INTERNAL COMBUSTION ENGINE WITH AIR-FUEL MIXTURE INJECTION includes a structure for supplying assist air to an air-fuel mixture injection valve including a device for limiting the intake air taken by a compressor whereby a drive force of the compressor required for compressing air is reduced and fuel efficiency is achieved.

U.S. Pat. No. 6,481,393 and published US patent application 2005/0076881 in the name of Drew set forth an INTERNAL COMBUSTION ENGINE with COMPOUND PISTON ASSEMBLY while U.S. Pat. No. 3,786,790 issued to Plevyak sets forth a DOUBLE CHAMBERED RECIPROCATEABLE DOUBLE ACTION PISTON INTERNAL COMBUSTION ENGINE.

Additionally, U.S. Pat. Nos. 4,216,753 and 4,414,944 set forth early attempts to improve the efficiency and performance of internal combustion engines. Finally, published US patent applications US 2016/0017845, US 2014/0144406 and US 2014/0076291 set forth more recent efforts to improve the efficiency and performance of internal combustion engines.

While the foregoing systems, devices and structures have, to some extent, improve the art and, in some instances, achieved commercial success, there remains nonetheless a long felt unresolved and continuing need in the art for more improved, efficient and powerful internal combustion engine which may be fabricated without prohibitively increased manufacturing costs.

SUMMARY OF THE INVENTION

Accordingly, it is a general object of the present invention to provide an improved, more efficient and powerful internal combustion engine. It is a more particular object of the present invention to provide an improved, more efficient and powerful internal combustion engine that may be fabricated without prohibitively increasing manufacturing costs.

In accordance with the present invention, there is provided An internal combustion engine comprising: a combustion cylinder having an igniter and a combustion piston moveable within the combustion cylinder; a compression cylinder and a compression piston moveable within the compression cylinder; a crankshaft rotatably supported and defining first and second eccentric crankshaft lobes; a first connecting rod connecting the combustion piston to the first crankshaft lobe; a second connecting rod connecting the compression piston to the second crankshaft lobe; a transfer plenum coupled between the combustion cylinder and the compression cylinder; and a fuel/air input coupled to the compression cylinder to provide a flow of fuel/air mixture to the compression cylinder, the crankshaft rotating to move the compression piston in reciprocating motion within the compression cylinder and to move the combustion piston in reciprocating motion within the combustion cylinder whereby the compression piston draws fuel/air mixture from the fuel/air input into the compression cylinder and thereafter transfers fuel/air mixture to the combustion cylinder and wherein the igniter ignites the fuel/air mixture within the combustion cylinder.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
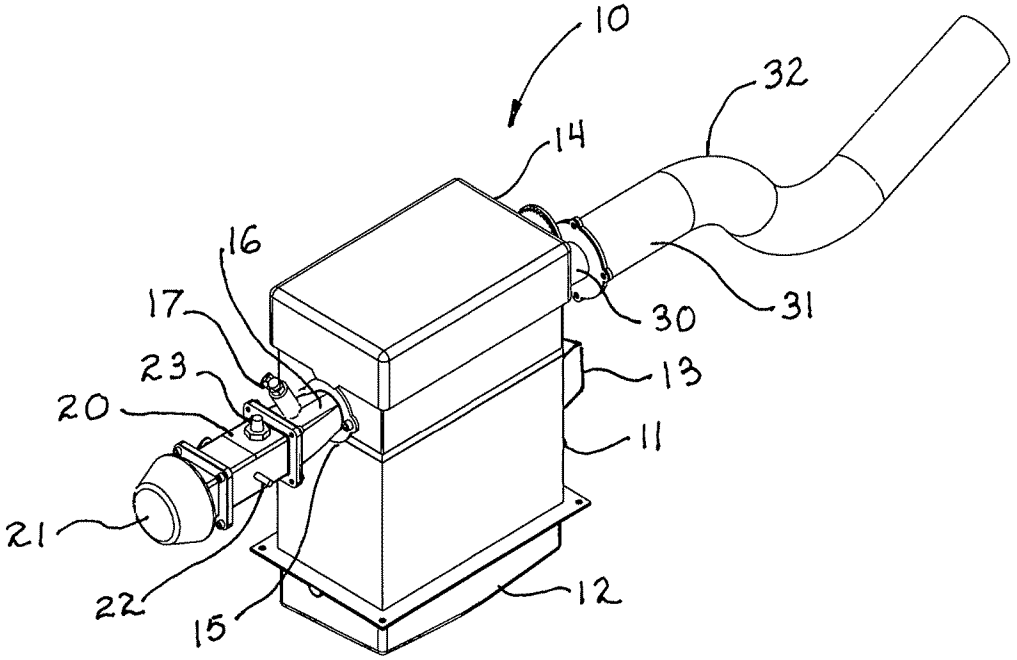
FIG. 1 sets forth a perspective view of an internal combustion engine having a fuel/air induction system constructed in accordance with the present invention.

FIG. 1 sets forth a perspective view of an internal combustion engine having fuel/air induction system constructed in accordance with the present invention and generally referenced by 10. Internal combustion engine 10 includes an engine block 11 fabricated in the manner set forth below together with an oil pan 12 secured to the bottom of engine block 11. Internal combustion engine 10 further includes a cylinder head cover 14 also secured to engine block 11. An exhaust valve housing 13 is secured to engine block 11 and encloses an exhaust valve set forth and described below in FIG. 4.

Engine block 11 further includes an intake port 15 having an intake manifold 16 joined thereto. Intake manifold 16 further supports a fuel injector 17 which is fabricated in accordance with conventional fabrication techniques and which will be understood to be operatively coupled to a fuel supply system (not shown) which is also of standard fabrication. It will be apparent to those skilled in the art that fuel may alternatively be combined with the input air to the engine using carburetors other fueling devices without departing from the spirit and scope of the present invention. A throttle body 20 is coupled to intake manifold 16 and further supports and input air filter 21 together with a throttle shaft 22. As is better seen in FIG. 4, throttle shaft 22 supports a throttle butterfly which responds to rotation of shaft 22 to control airflow through throttle body 20. A mass airflow sensor 23 is also supported by throttle body 20 and is exposed to the flow of input air therein. Internal combustion engine 10 further includes an exhaust port 30 extending from engine block 11 which in turn supports an exhaust manifold 31 and an exhaust pipe 32. The present invention will be understood to include a conventional lubrication system (not shown) such as passive, wet or dry sump oilers, or the like.

In operation, internal combustion engine 10 will be understood to be provided with a number of support components which may be of conventional fabrication and which are not shown in FIG. 1. For example, in typical use of internal combustion engine 10 engine block 11 is supported by a plurality of engine port mounts (not shown). Similarly, the above mentioned connection of fuel injector 17 to a conventional fuel supply system, while not seen in FIG. 1 will be understood to be utilized in the operation of internal combustion engine 10. Finally, in the typical environment in which internal combustion engine 10 is operated sensor 23 will be understood to be operatively coupled to a processor controlled engine controller (not shown).

Figure 2:
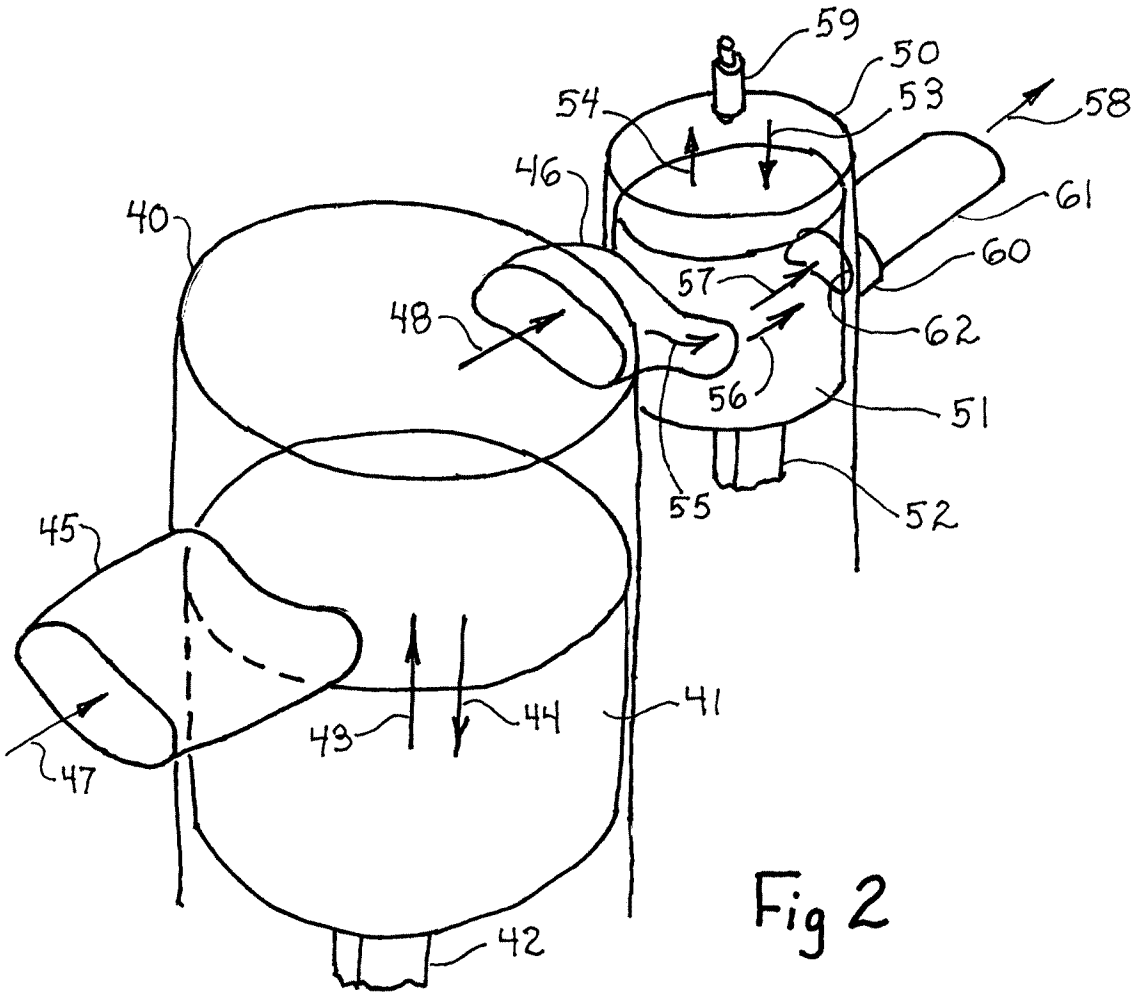
FIG. 2 sets forth a simplified operational diagram of the present invention fuel/air induction system.

FIG. 2 sets forth a simplified operational diagram of the basic functioning components of the present invention internal combustion engine having fuel/air induction system which is believed to be helpful in understanding the operation of the present invention. By way of overview, the present invention internal combustion engine having fuel/air induction system differs from previously provided internal combustion engines in that a crankshaft-driven compression piston is reciprocated within a fuel air compression cylinder in a cooperative operation which charges a combustion cylinder with a charge of fuel/air mixture under pressure during each engine cycle. A combustion piston is reciprocated by the crankshaft within the combustion cylinder to further compress the fuel/air mixture charge and harness the power of the ignited mixture. It will be noted that the present invent embodiment shown in FIG. 2 may omit exhaust valve 60 and instead pressurize the engine crankcase and utilize an expansion chamber in the typical two stroke engine fabrication, if desired. It will be noted that the number, size and location of the transfer ports used in the present invention engine may be adjusted and varied to provide a desired torque and power characteristic.

Accordingly, FIG. 2 shows the basic configuration of the present invention internal combustion engine having fuel/air induction system which utilizes a single fuel air compression cylinder and a single combustion cylinder. It will be apparent to those skilled in the art that while a single pair of cylinders is utilized in the explanations which follow, multiple combinations of compression cylinders and combustion cylinders may be utilized without departing from the spirit and scope of the present invention. It will also apparent to those skilled in the art that eliminates the need to pressurize the engine crankcase with a fuel/air mixture. A fuel/air compression cylinder 40 supports a compression piston 41 which is reciprocated by a connecting rod 42. In the manner described below connecting rod 42 will be understood to be coupled to a crankshaft to provide receptacle motion in the directions indicated by arrows 43 and 44. In accordance with an important aspect of the present invention, it will be noted in the descriptions that follow that compression cylinder 40 and compression piston 41 are not subjected to fuel combustion As a result, compression cylinder 40 and compression piston 41 need not be fabricated of a heat resistant metal, but may be fabricated of a composite material, or the like, to reduce overall engine weight and particularly reciprocating weight. Fuel/air compression cylinder 40 further includes a fuel/air input 45 and a fuel/air transfer plenum 46. In a similar fashion a combustion cylinder 50 supports a combustion piston 51 which is reciprocated by a connecting rod 52. Connecting rod 52 will be understood to be coupled to a rotating crankshaft resulting in reciprocating motion within combustion cylinder 50 in the directions indicated by arrows 53 and 54. Combustion cylinder 50 further includes an exhaust port 62 and an exhaust valve 60, shown below in greater detail, and an exhaust pipe 61. In the manner described below exhaust gases are vented outwardly from combustion cylinder 50 by valve 60 and exhaust pipe 61 flowing in the direction indicated by arrows 57 and 58. While not shown in FIG. 2, in the preferred fabrication of the present invention compression piston 41 and combustion piston 51 are preferably phased to reciprocate in a 180 degree phase relationship. That is to say, when compression piston 41 is at top dead center, combustion piston 51 is at bottom dead center and conversely, when compression piston 41 is at bottom dead center, combustion piston 51 is at top dead center.

In operation, an engine cycle is initiated as compression piston 41 moves downwardly in the direction indicated by arrow 44 causing an inward flow of fuel/air mixture through fuel/air input 45 in the direction indicated by arrow 47. In this manner, a charge of fuel/air mixture is drawn into compression cylinder 40. Thereafter, compression piston 41 is moved upwardly in the direction indicated by arrow 43 which compresses the charge of fuel/air mixture within compression cylinder 40. It will be noted that the phase relationship between the motions of compression piston 41 and combustion piston 51 positions combustion piston 51 to block fuel/air transfer plenum 46. As a result, the movement of compression piston 41 to top dead center compresses the fuel/air mixture charge within fuel/air compression cylinder 40. As compression piston 40 rises toward top dead center, combustion piston 51 moves downwardly beyond fuel/air transfer plenum 46 and exhaust valve 60. Concurrently, exhaust valve 60 is opened. This allows the spent exhaust gases to escape through exhaust valve 60 and exhaust pipe 61 and also allows the fuel/air mixture charge within compression cylinder 40 to flow from compression cylinder 40 through fuel/air transfer plenum 46 into combustion cylinder 50 in the direction indicated by arrows 48, 55 and 56. This results in a transfer of a fresh charge of fuel/air mixture into combustion cylinder 50 and the venting of spent exhaust gases from combustion cylinder 50 prior to the next upward stroke of combustion piston 51.

As compression piston 41 moves downwardly in the direction indicated by arrow 44, drawing a new fuel/air mixture charge into fuel/air compression cylinder 40, combustion piston 51 moves upwardly in the direction indicated by arrow 54 closing fuel/air transfer plenum 46 and exhaust port 62. The upward movement of combustion piston 51 then compresses the previously transferred fuel/air mixture charge within combustion cylinder 50. Once combustion piston 51 reaches a near top dead center position, a fuel igniter 59 is activated and the compressed fuel/air mixture charge within combustion cylinder 50 combusts burning the fuel and driving combustion piston 51 downwardly in the direction indicated by arrow 53 in a power stroke. The downward power stroke of combustion piston 51 coincides with the upward compression stroke of compression piston 41 causing the engine cycle to repeat.

FIGS. 3A through 3D set forth sequential diagrams showing the operation of a two-stroke embodiment of the present invention internal combustion engine. The operational diagrams shown set forth a sequence of a two-stroke internal combustion engine constructed in accordance with the present invention. FIGS. 3A through 3D show a compression cylinder 40 within which a compression piston 41 is reciprocated by a crankshaft and connecting rod combination (not shown). Also shown is a combustion cylinder 50 within which a combustion piston 51 is reciprocated by the same crankshaft and connecting rod mechanism (not shown). Compression cylinder 40 is connected to a fuel/air mixture input 45 and a fuel/air transfer plenum 46. Similarly, combustion cylinder 50 is connected to fuel/air transfer plenum 46 and exhaust port 62 and exhaust valve 60.

Figure 3A:
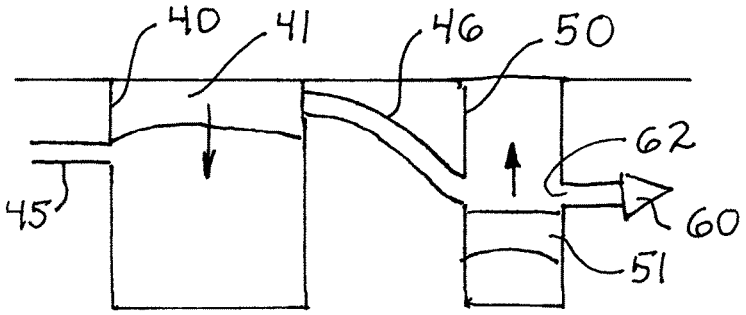
FIGS. 3A through 3D set forth sequential illustrations of the operation of the present invention fuel/air induction system.

FIG. 3A shows compression piston 41 near its top dead center position and beginning a downward movement within compression cylinder 40. Correspondingly, FIG. 3A also shows combustion piston 51 at its bottom dead center beginning to move upwardly. This relative positioning of compression piston 41 and combustion piston 51 is the result of the above mentioned opposite phasing between the pistons.

Figure 3B:
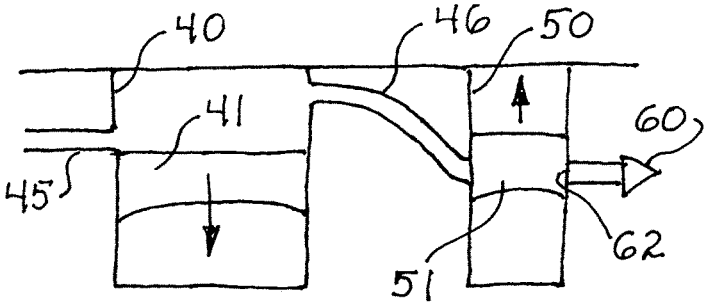

FIG. 3B shows compression piston 41 having moves downwardly opening input 45 and allowing fuel/air mixture to be drawn into compression cylinder 40. Concurrently, compression piston 51 is moving upwardly within combustion cylinder 50 and has closed fuel/air transfer plenum 46 and exhaust port 62. At this point, fuel/air mixture is being compressed within combustion cylinder 50 and a fresh charge of fuel/air mixture is being drawn into compression cylinder 40.

Figure 3C:
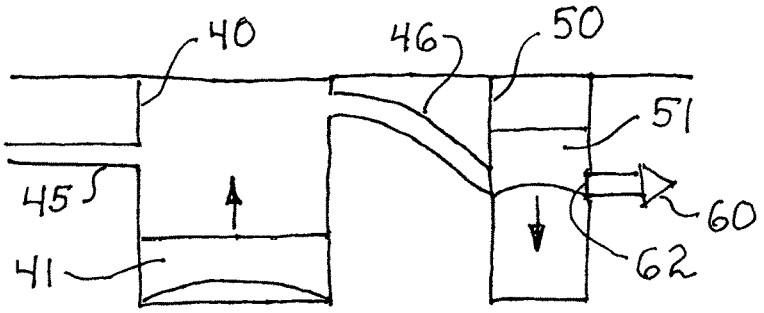

FIG. 3C shows compression piston 41 having reached bottom dead center and combustion piston 51 having reached top dead center. At this point a full charge of fresh fuel/air mixture has been drawn into compression cylinder 40 and ignition of the compressed fuel/air mixture within combustion cylinder 50 occurs. The combustion of fuel/air mixture within combustion cylinder 50 drives combustion piston downwardly and drives compression piston 41 upwardly. Thus combustion piston 51 travels in a power stroke while compression piston 41 compresses the fuel/air mixture within compression cylinder 40.

Figure 3D:
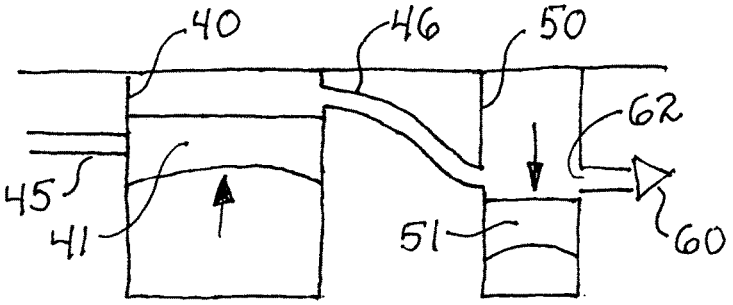

FIG. 3D shows compression piston 41 approaching top dead center and combustion piston 51 nearing bottom dead center following its power stroke. In this position fuel/air transfer plenum 46 is open and the compressed fuel/air mixture within compression cylinder 40 flows through fuel/air transfer plenum 46 into combustion cylinder 50. Concurrently, exhaust port 62 and exhaust valve 60 are open allowing exhaust gases to be vented from combustion cylinder 50. In accordance with conventional two-stroke engine operation, it will be noted that fuel/air transfer plenum 46 and exhaust port 62 are simultaneously open. The result is a crossflow as fresh fuel/air mixture flows into combustion cylinder 50 and exhaust gases flow outwardly from combustion cylinder 50. As compression piston 41 reaches top dead center and combustion piston 51 reaches bottom dead center, the engine returns to the configuration shown in FIG. 3A and a new cycle of engine operation occurs.

Accordingly, it will be seen that the present invention internal combustion engine having fuel/air induction system provides a crankshaft driven compression piston within a compression cylinder to repeatedly draw and compress a charge of fuel/air mixture which is then injected into the combustion cylinder to be compressed, ignited and provide power for engine output. It will be apparent to those skilled in the art that the present invention system operates to ensure the precise and efficient fuel/air induction of the combustion cylinder without the use of external apparatus such as blowers, superchargers or turbochargers.

FIGS. 4 through 8 set forth sequential section views of a two stroke internal combustion engine generally referenced by numeral 70. The sequence of section views set forth in FIGS. 4 through 8 illustrate the operational cycle of internal combustion engine 70 utilizing the present invention fuel air induction system. Initially, however, it will be noted that in accordance with an important aspect of the present invention, the fuel/air induction system of the invention is provided without the use of additional engine belts, chains or gears to drive the fuel/air induction. The inventive fuel/air induction system is internal to the engine rather than "bolted on".

Thus, with concurrent reference to FIGS. 4 through 8, and in accordance with the present invention, internal combustion engine 70 includes an engine block 71 having a compression cylinder 73 and a combustion cylinder 90 formed therein. A fuel/air transfer plenum 84 extends between compression cylinder 73 and combustion cylinder 90. Engine block 71 supports a pair of crankshaft bearings 101 and 102 which in turn rotatably support a crankshaft 100. Crankshaft 100 includes a pair of oppositely phased crankshaft lobes 104 and 105. As mentioned above, the preferred fabrication of the present invention internal combustion engine having fuel/air induction system utilizes oppositely phased or 180 degrees of separation between the compression cylinder and the combustion cylinder. Accordingly, eccentric lobes 104 and 105 of crankshaft 100 are separated by 180 degrees. Internal combustion engines 70 further includes a compression piston 74 supported by a connecting rod 75 which intern is operatively coupled to crankshaft lobe 105. Internal combustion engine 70 further includes a combustion piston 91 within combustion cylinder 90 supported by a connecting rod 85 which in turn is coupled to eccentric lobe 104 of crankshaft 100.

Internal combustion engine 70 further includes an input port 76 formed in compression cylinder 73 and an intake manifold 77 coupled to intake port 76. A fuel injector 78 is supported within intake manifold 77. A throttle body 79 is joined to intake manifold 77 and supports an air filter 83. A throttle shall 80 is rotatably supported within throttle body 79 and further supports a throttle butterfly 81. An airflow sensor 82 is supported within throttle body 79.

Internal combustion engine 70 further includes a cylinder head 72 secured to the upper portion of the engine block 71 providing closure of compression cylinder 73 and combustion cylinder 90. Cylinder head 72 further supports a conventional spark plug 99 which extends into combustion cylinder 90.

Combustion cylinder 90 further includes an exhaust port 93 which in turn is coupled to an exhaust valve mechanism 94. Exhaust valve mechanism 94 includes a valve stem 95 together with a valve rocker arm 96. One end of rocker arm 96 is joined to valve stem 95 while the remaining end thereof is positioned against a push rod 98. A spring 97 provides a spring force urging valve rocker 96 against pushrod 98 and urging pushrod 98 against surface 107 of crankshaft 100. Surface 107 of crankshaft 100 defines a cam 106 (seen in FIG. 5) which operates pushrod 98 to open exhaust valve 94 in the manner also seen in FIG. 5.

Figure 4:
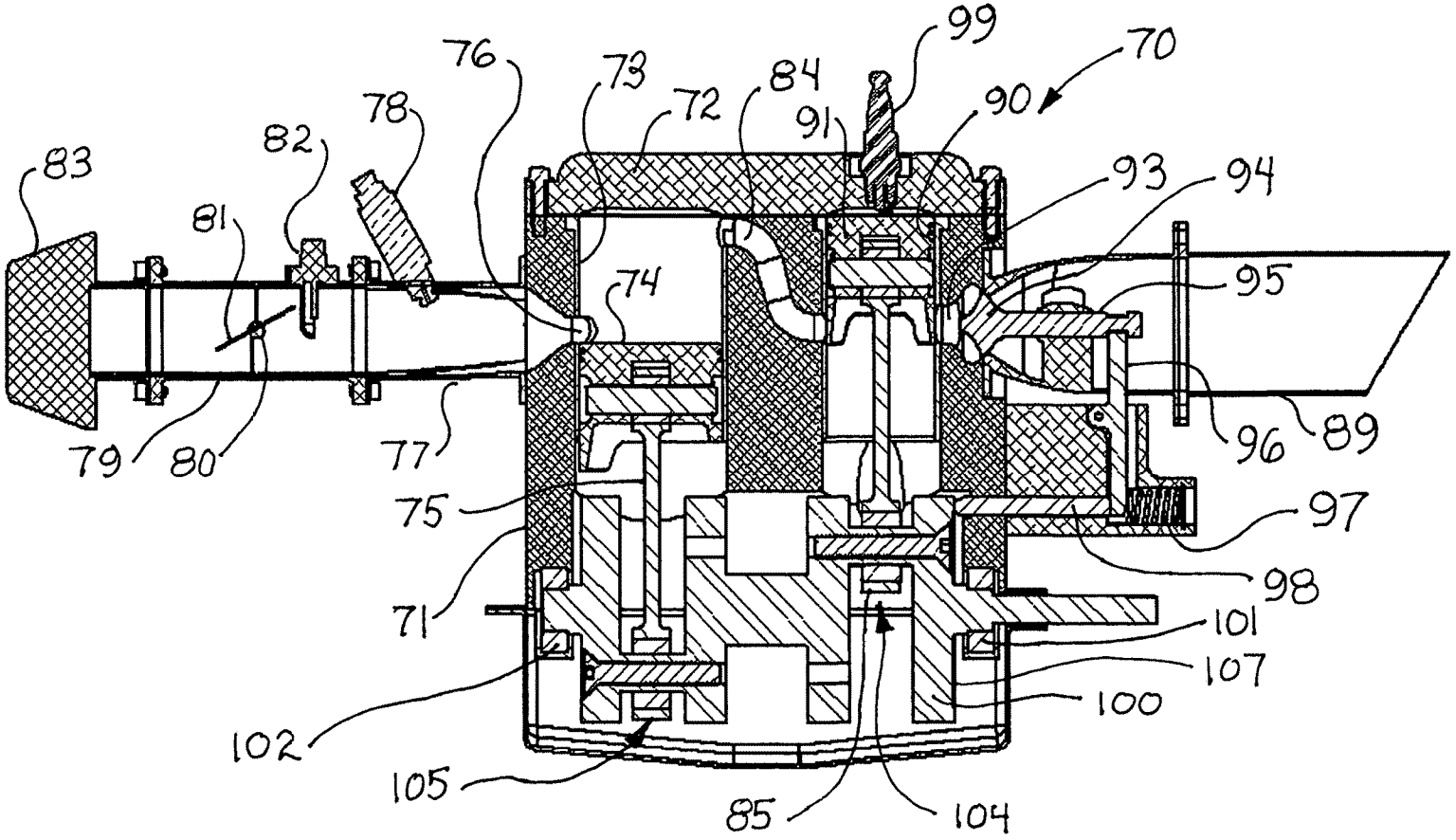
FIGS. 4 through 8 set forth sequential section views of a two-stroke internal combustion engine illustrating an operational cycle of the present invention fuel/air induction system.

With specific reference to FIG. 4, internal combustion engine 70 is shown at a point in the two-stroke operational cycle of the engine in which combustion piston 91 is at top dead center while compression piston 74 is at bottom dead center. Additionally, it will be noted that exhaust valve 94 is closed which in turn closes exhaust port 93. As spark plug 99 is activated, the compressed fuel/air mixture within combustion cylinder 90 is ignited producing a downward force upon combustion piston 91. This downward force of combustion piston 91 rotates crankshaft 100 causing compression piston 74 to begin moving upwardly. At the operational point shown in FIG. 4 compression cylinder 73 has been filled with a quantity of fuel/air mixture and as compression piston 74 begins moving upwardly input port 76 is closed by the compression piston. As the rotation of crankshaft 100 continues, internal combustion engines 70 moves to the configuration shown in FIG. 5.

Figure 5:
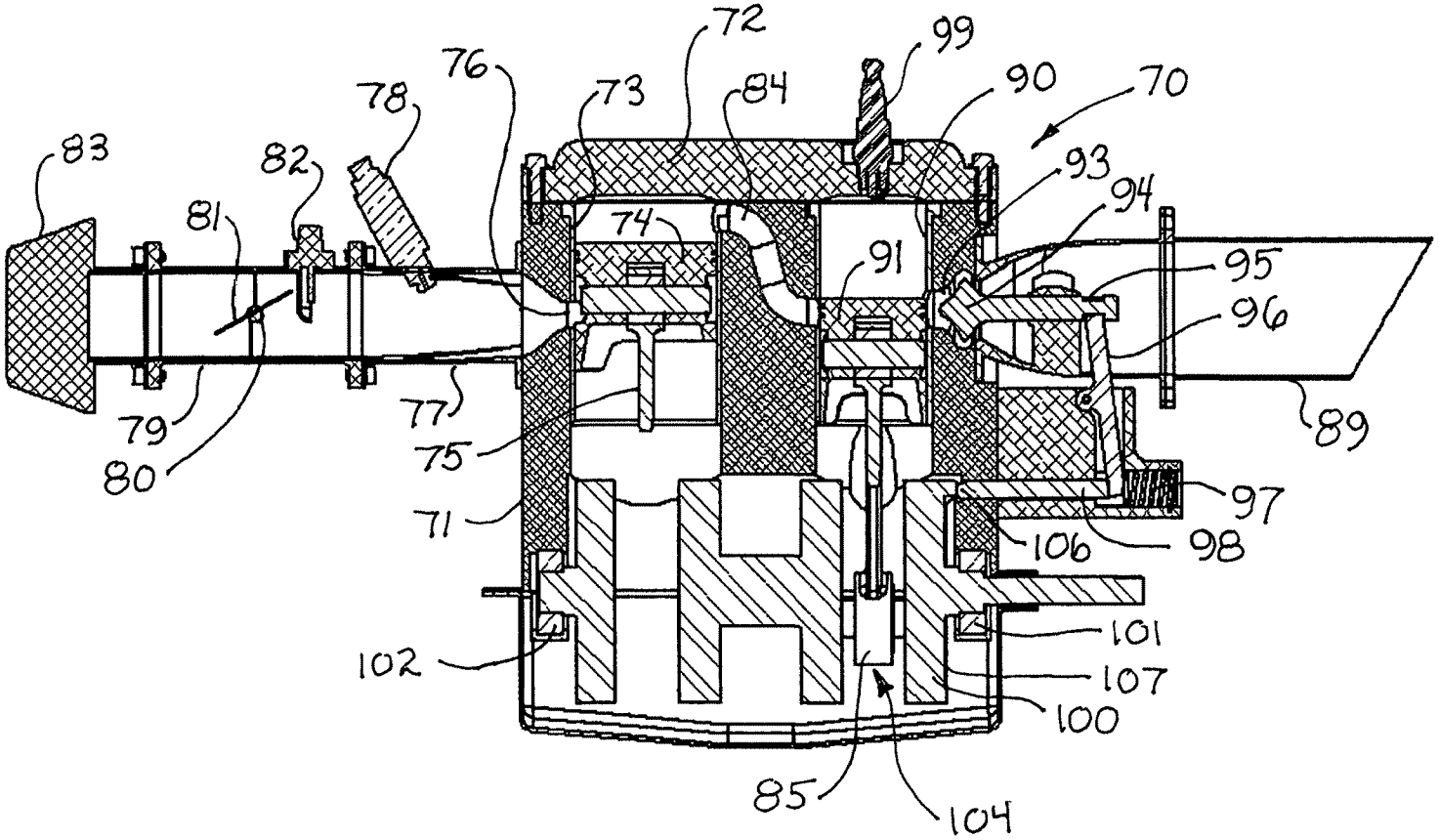

FIG. 5 sets forth a section view of internal combustion engine 70 during a power stroke of combustion piston 91. At the point shown in FIG. 5, combustion piston 91 has moved downwardly to begin opening exhaust port 93 and fuel/air transfer plenum 84 within combustion cylinder 90. Concurrently, compression piston 70 or has continued upwardly and compresses the fuel/air mixture within compression cylinder 73. It will be noted that at the position shown in FIG. 5, combustion piston 91 still maintains closure of fuel/air transfer plenum 84. As a result the fuel/air mixture within compression cylinder 73 remains compressed by compression piston 74. It will also be noted that cam 106 on surface 107 of crankshaft 100 forces pushrod 98 against the force of spring 97 thereby pivoting valve rocker 96 and moving valve stem 95 to an open valve position.

Figure 6:
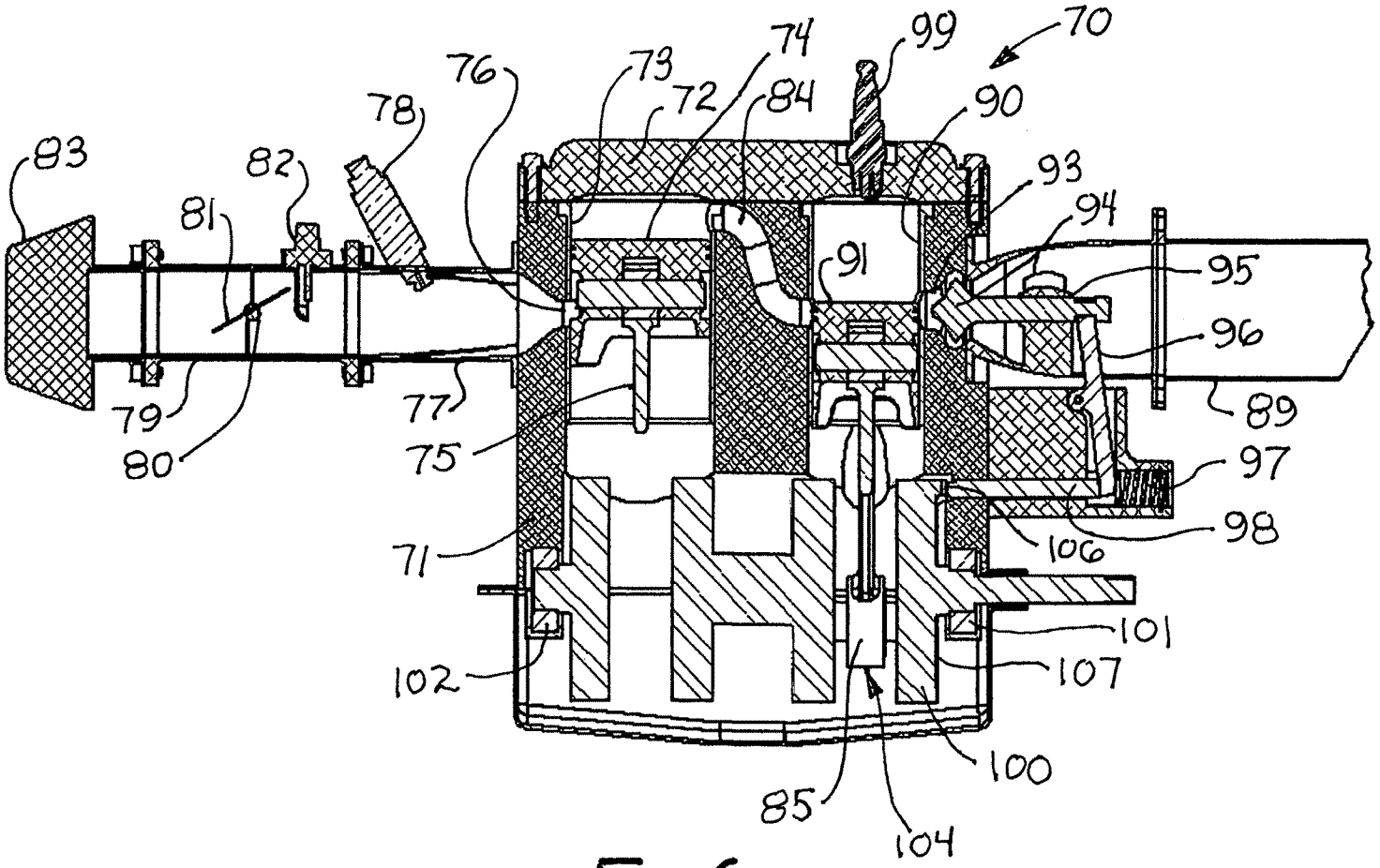

FIG. 6 sets forth a section view of internal combustion engine 70 during the portion of a power stroke of combustion piston 91 at the point at which combustion piston 91 begins opening air/fuel transfer plenum 84 to allow compressed fuel/air mixture to begin flowing into combustion cylinder 90. Also at this point, with exhaust valve 94 open combustion piston 94 begins opening exhaust port 93 allowing an outward flow of burned gases within combustion cylinder 90 to flow outwardly through the engine exhaust system. It will be noted that exhaust valve 94 is maintained in an open condition by the action of cam 106 against pushrod 98.

Figure 7:
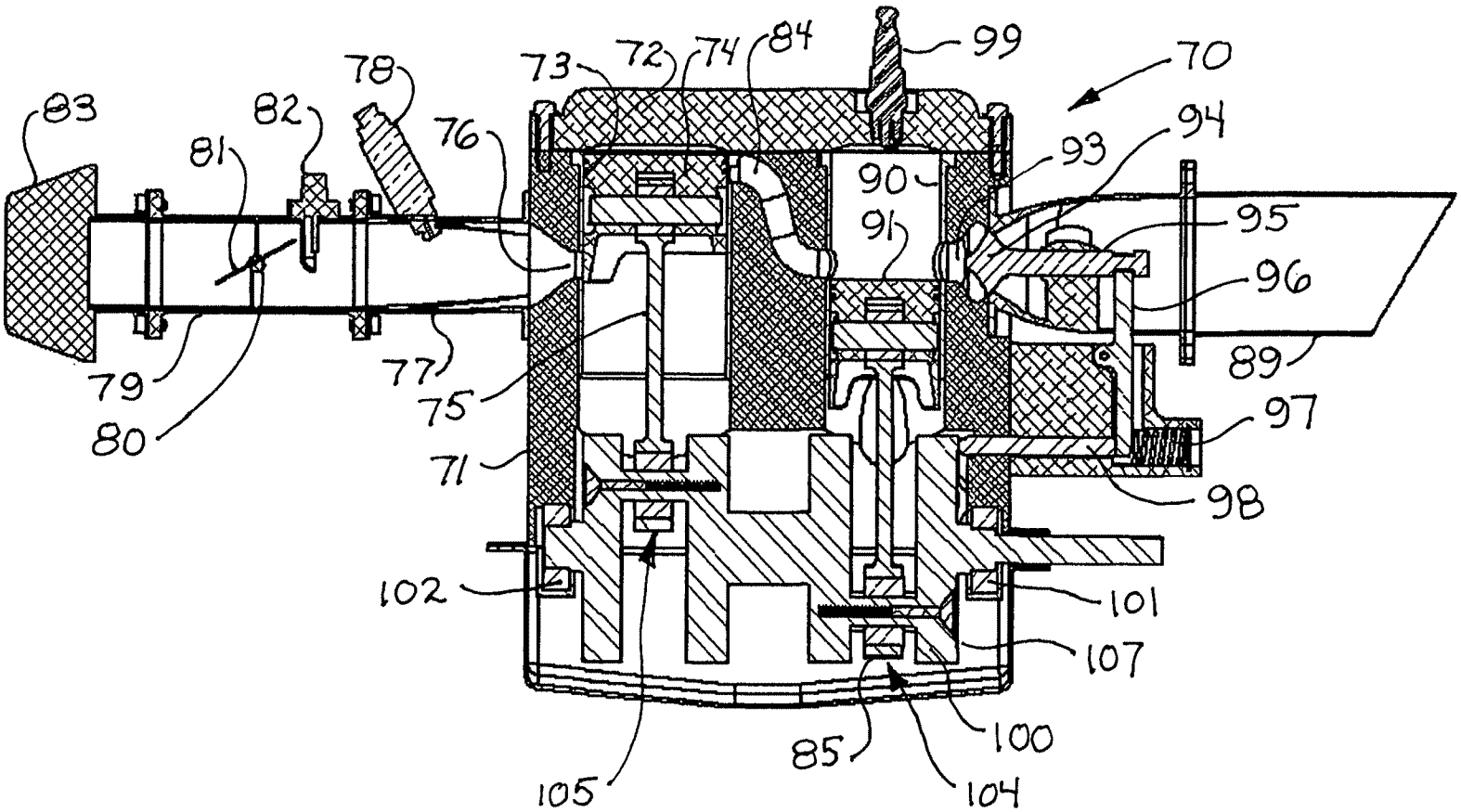

FIG. 7 sets forth a section view of internal combustion engine 70 characterized by compression piston 74 being at top dead center and combustion piston 91 being at bottom dead center. At this position air/fuel transfer plenum 84 is open to combustion cylinder 90 allowing compressed fuel/air mixture to flow into combustion cylinder 90. Concurrently, with exhaust valve 94 having moved to a closed condition further venting of gases from combustion cylinder 90 is prevented. The fresh fuel/air charge transferred from compression cylinder 73 two combustion cylinder 90 is now ready for compression as combustion piston 91 begins moving upwardly to the configuration shown in FIG. 8.

Figure 8:
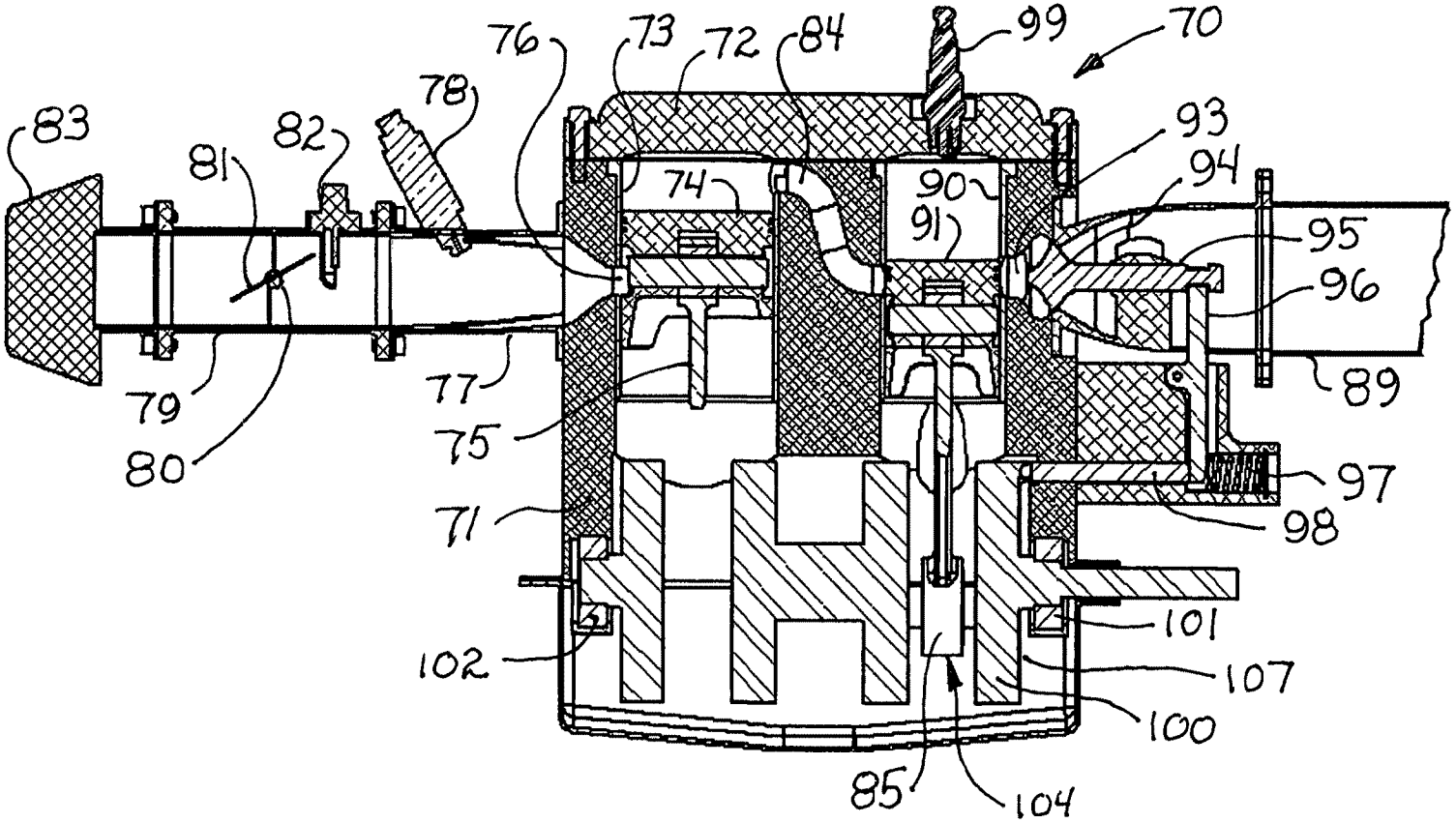

FIG. 8 sets forth a section view of internal combustion engine 70 during the compression stroke of combustion piston 91 moving upwardly within combustion cylinder 90. Concurrently exhaust valve 94 is closed and compression piston 74 has begun moving downwardly. The position of combustion piston 91 within combustion cylinder 90 maintains closure of fuel/air transfer plenum 84 and exhaust 73. At this point, internal combustion engines 70 is returning to the configuration shown in FIG. 4 as the two stroke operational cycle of internal combustion engine 70 is repeated.

FIG. 8 sets forth a perspective view of an alternate embodiment of the present invention internal combustion engine, generally referenced by 110, having fuel/air induction system which utilizes an overhead valve arrangement operating on a two stroke internal combustion engine. Internal combustion engine 110 is generally similar to internal combustion engine 10 shown in FIG. 1 with the further addition of a crankshaft gear, timing chain and camshaft gear required to provide operation of the engine overhead valve. The operation of the present invention fuel/air mixture induction system remains stanch really the same as shown and described above.

More specifically, internal combustion engine 110 includes an engine block 111 having an oil pan 112 on the lower end thereof. A cylinder head 117 is secured upon the upper end of the engine block 111 and further supports a valve cover 113. An intake manifold 120 is secured to and is in communication with an intake port (not shown) formed in cylinder head 117. A throttle body 122 is coupled to intake manifold 120 and supports an air filter 124. Throttle body 122 further supports an airflow sensor 123. A fuel injector 121 is supported upon intake manifold 120. Cylinder head 117 further defines an exhaust port 114 having an exhaust manifold 115 coupled thereto. An exhaust pipe 116 is joined to exhaust manifold 1/5 teen. A crankshaft and 126 extends outwardly from engine block 111 and oil pan 112 and supports a timing gear 127. Cylinder head 117 further supports a camshaft 129 having a timing gear 128 supported thereon. A timing chain 130 extends between timing gears 127 and 128. It will be noted that because internal combustion engine 110 is a two-stroke engine, camshaft 129 is rotated at the same rate as the engine crankshaft. Therefore timing gears 127 and 128 are the same size.

Figure 10:
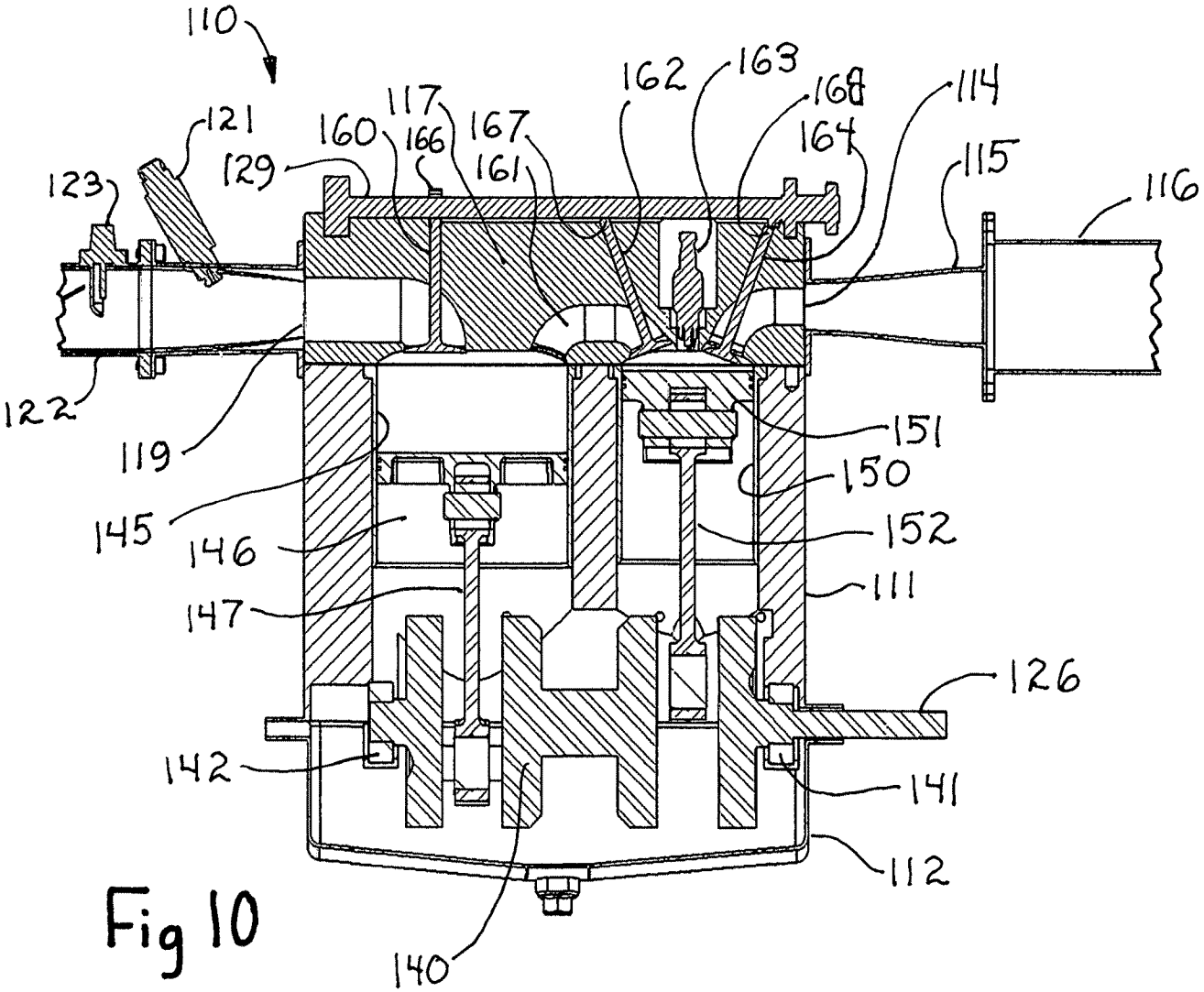
FIG. 10 sets forth a section view of a further alternate embodiment of the present invention internal combustion engine having fuel/air induction system utilizing an overhead valve arrangement.

FIG. 10 sets forth a section view of internal combustion engine 110. As described above, internal combustion engine 110 includes an engine block 111, a cylinder head 117 and an oil pan 112. As is also described above internal combustion engine 110 includes an input manifold 120 supporting a fuel injector 121 together with a throttle body 122 which supports an airflow sensor 123. Cylinder head 117 includes an exhaust port 114 to which an exhaust manifold 115 and an exhaust pipe 116 are coupled. Engine block 111 further includes a compression cylinder 145 within which a compression piston 146 is supported by a connecting rod 147. Similarly, engine block 111 includes a combustion cylinder 150 within which a combustion piston 151 is reciprocated by a connecting rod 152. A crankshaft 140 is rotatably supported upon the lower and of engine block 111 by a pair of bearings 141 and 142. Connecting rods 147 and 152 are coupled to crankshaft 140.

Figure 9:
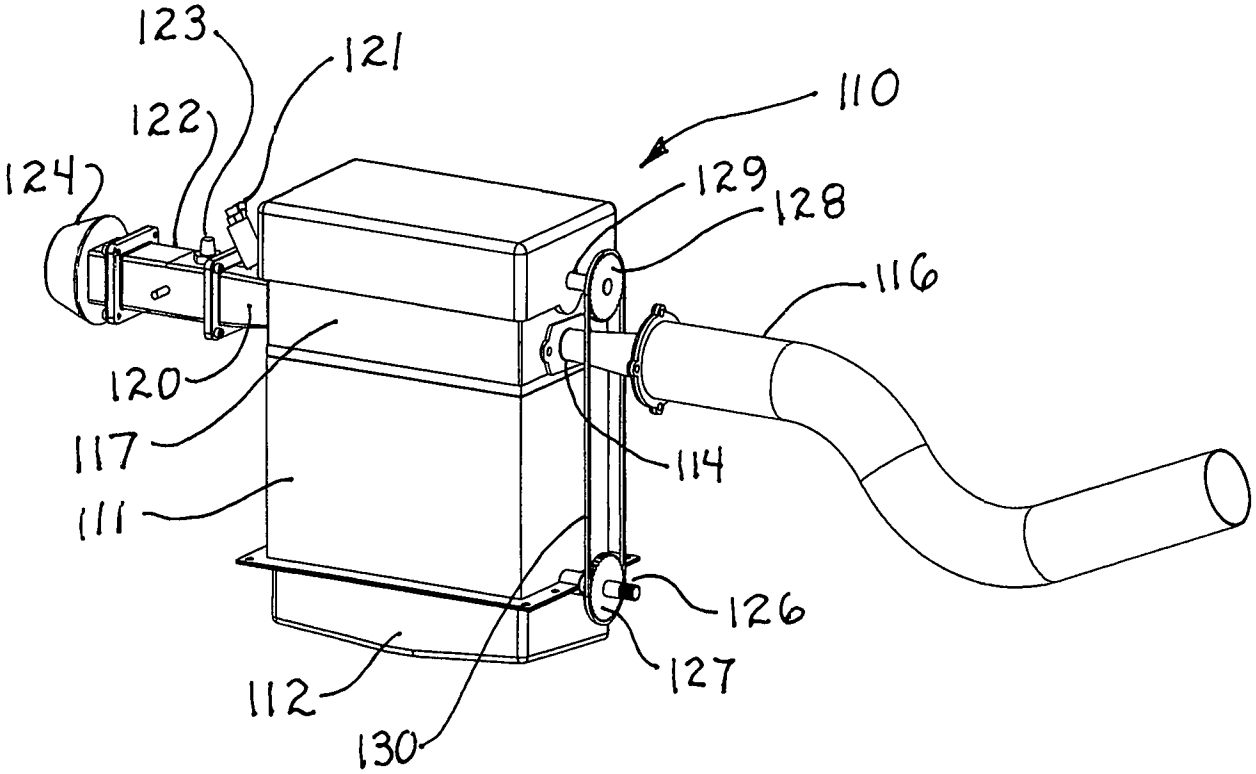
FIG. 9 sets forth a perspective view of an alternate embodiment of the present invention internal combustion engine having fuel/air induction system.

Cylinder head 117 defines and input port 119 extending into the upper portion of compression cylinder 145. Cylinder head 117 further defines a transfer plenum 161 which extends between compression cylinder 145 and combustion cylinder 150. Exhaust port 114 extends into cylinder head 117 and terminates in the upper portion of combustion cylinder 150. And intake valve 160 is ported within cylinder head 117 to control intake port 119. A transfer plenum valve 162 is supported within cylinder head 117 and is operative to control flow through transfer plenum 161. An exhaust valve 164 is supported within cylinder head 117 and is operative to control flow through exhaust port 114. Internal combustion engine 110 further includes a camshaft 129 rotatably supported upon cylinder head 117 by means not shown. Camshaft 129 includes a cam lobe 166 which operates intake valve 160. Camshaft 129 further includes a cam lobe 167 which operates transfer plenum valve 162 and a cam lobe 168 which operates exhaust valve 164. The structure set forth in FIG. 10 is somewhat simplified in that the conventional valve spring and associated apparatus which maintains valves 161, 162 and 164 in a normally closed position is not shown to avoid unduly cluttering the figure. However, suffice it to note that by valve spring apparatus (not shown) valves 160, 162 and 164 are maintained in a normally closed position. Correspondingly, it will be understood that as camshaft 129 is rotated cam lobe 166 opens intake valve 160. Similarly, rotation of camshaft 129 causes cam lobe 167 to open transfer plenum valve 162. Finally rotation of camshaft 129 causes cam lobe 168 to open exhaust valve 164. As is seen in FIG. 9 camshaft 129 is caused to rotate as crankshaft 140 rotates by the cooperation of timing gears 127 and 128 together with timing chain 130.

With respect to the present invention fuel/air induction system, internal combustion engine 110 functions in substantially the same manner as internal combustion engines 10 and 70 in that the reciprocation of compression piston 146 within compression cylinder 145 draws in and compresses repeated charges of fuel/air mixture during engine operation which are transferred to combustion cylinder 150 through transfer plenum 161 to provide a fuel/air mixture charge which is compressed within combustion cylinder 150 by combustion piston 151. By further similarity the ignition and burning of the compressed fuel air mixture provided within combustion cylinder 150 provides power to combustion piston 151 which intern rotates crankshaft 140. Internal combustion engine 110 differs from internal combustion engines 10 and 70 described above in the use of an overhead valve system rather than the cylinder wall porting more typical of two-stroke internal combustion engines.

Figure 11:
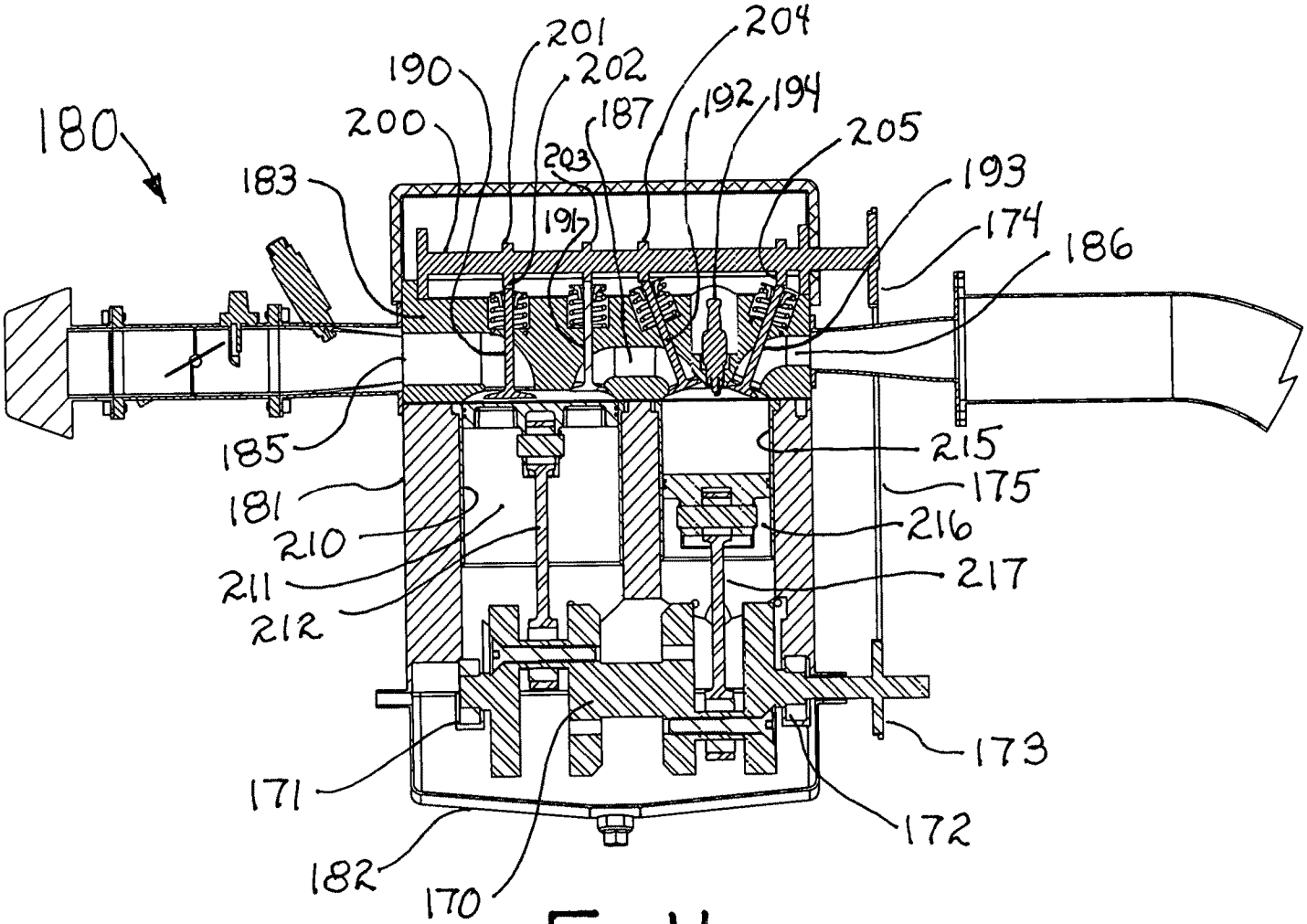
FIG. 11 sets forth a section view of a still further alternate four stroke embodiment of the present invention internal combustion engine having fuel/air induction system.

FIG. 11 sets forth a section view of a still further alternate embodiment of the present invention internal combustion engine having fuel/air induction system in which a four stroke internal combustion engine, generally referenced by numeral 180, is provided. Internal combustion engine 180 includes an engine block 181 having a crankshaft 170 supported by a pair of crankshaft bearings 171 and 172. Crankshaft 170 further supports a timing gear 173. Engine block 181 defines a compression cylinder to 10 and a compression piston to eat 11. Compression piston to 11 is supported for reciprocating motion within compression cylinder to 10 by a connecting rod 212 which in turn is coupled to an eccentric lobe of crankshaft 170. Engine block 181 further includes a combustion cylinder 215 within which a combustion piston 216 is supported for reciprocating motion by a connecting rod to 17 which in turn is coupled to an eccentric lobe of crankshaft 170.

Internal combustion engine 180 further includes a cylinder head 183 joined to the top surface of engine block 181 by conventional fabrication (not shown). Cylinder head 183 defines an intake port 185 in communication with compression cylinder to 10 together with an exhaust port 186 in communication with combustion cylinder 215. Cylinder head 183 further defines a transfer plenum 187 extending between compression cylinder 210 and combustion cylinder 215. As seen above in FIG. 2, transfer plenum 187 defines an oblong, or oval, cross section giving transfer plenum sufficient volume to hold a double charge of fuel/air mixture provided by the dual induction strokes of compression piston 146 for each power stroke of combustion piston 216. Cylinder head 183 further supports and intake valve 190 controlling intake port 185 together with an output valve 191 controlling transfer plenum 187. Further, cylinder head 183 the ports a transfer valve 192 controlling the remaining and of transfer plenum 187 and an exhaust valve 193 controlling exhaust port 186. Conventional valve springs are supported within cylinder head 183 to maintain valves 190, 191, 192 and 193 in normally closed positions.

Internal combustion engine 180 further includes a camshaft 200 rotatably supported above cylinder head 183 by conventional bearing supports (not shown). Camshaft 200 includes and intake cam lobe 204 and an exhaust cam lobe 205. Camshaft 200 further includes a pair of opposed lobes 201 and 202 operative upon intake valve 190 together with and opposed pair of cam lobes 203 and 204 operative upon output valve 191. A conventional spark plug 194 is supported within cylinder head 183. Camshaft 200 further includes a timing gear 174 which is coupled to timing gear 173 by a timing chain 175.

In operation, internal combustion engine 180 includes compression piston 211 reciprocating within compression cylinder 210 to provide fuel/air mixture charges to be injected into combustion cylinder 215 in a similar manner to that set forth above. Because internal combustion engine 180 is a four stroke engine, compression piston 210 undergoes two intake and two induction strokes for each cycle of combustion piston 216 operating in a four stroke cycle within combustion cylinder 215. That is to say, each time combustion piston 216 undergoes a full cycle of intake, impression, power and exhaust, compression piston 211 will undergo two cycles of intake and compression during the same crankshaft rotation. To accommodate the four stroke operation of combustion cylinder 215 and combustion piston 216 transfer plenum 187 is initially pressurized with the first charge of fuel/air mixture provided by compression cylinder 210 and compression piston 211 after which a second charge of fuel/air mixture is forced into transfer plenum 187 further increasing the flow volume of fuel/air mixture that is transferred through transfer plenum 187 into combustion cylinder 215 when transfer valve 192 opens during an intake stroke of combustion piston 216. In order to provide this double induction action, camshaft 200 supports a double set of cam lobes 201 and 202 to operate intake valve 190 and a similar double set of camshaft lobes 203 and 204 to operate output valve 191.

Figure 12:
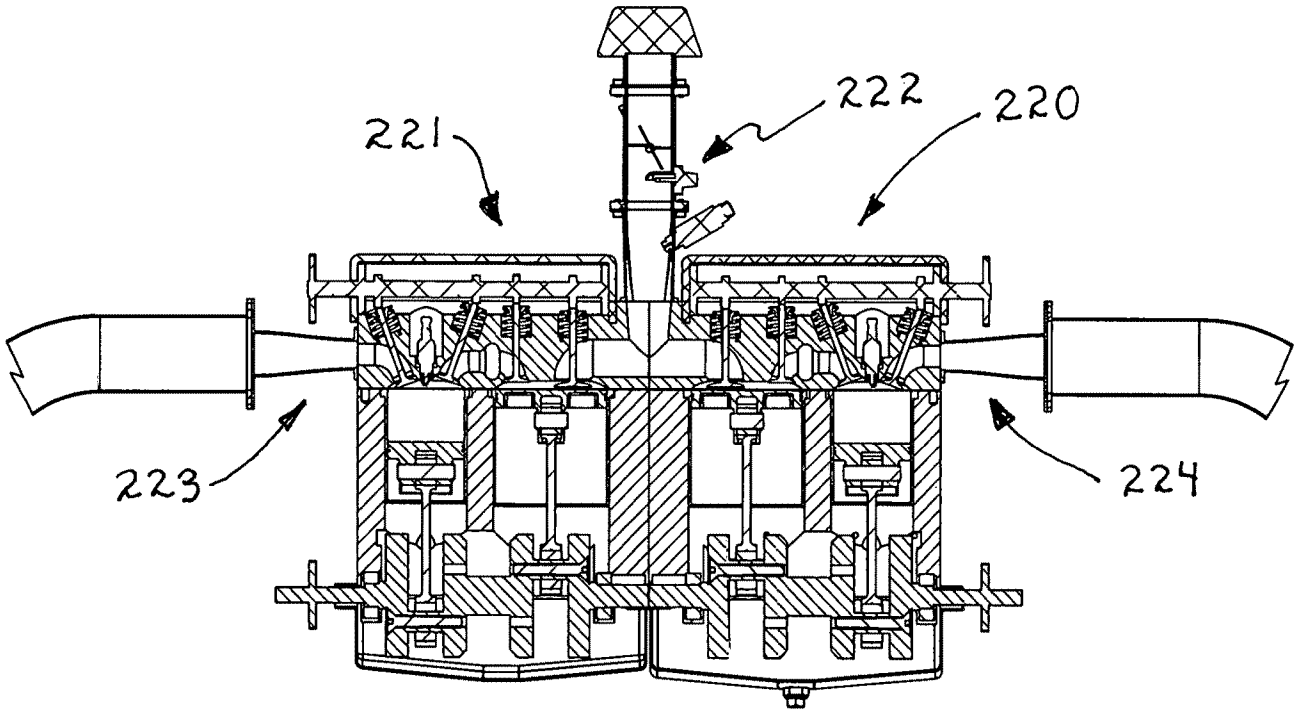
FIG. 12 sets forth a section view of a pair of internal combustion engines having fuel/air induction systems joined to form a multi-cylinder engine.

FIG. 12 sets forth a section view of a pair of internal combustion engines constructed in accordance with the present invention joined to form an engine having two combustion cylinders and two compression cylinders. It will be apparent to those skilled in the art that while FIG. 12 sets forth the example of two engines joined, a virtually endless number of basic engines may be joined to form still larger engines without departing from the spirit and scope of the present invention. It will be equally apparent to those skilled in the art that engines 220 and 221 may utilize a single common crankshaft or two crankshafts joined to provide a common crankshaft using bolted attachment or the like. Accordingly, engines 220 and 221 are joined for combined operation having their respective crankshafts joined for common rotation and thereafter operating as a single engine. Toward this end, a common intake for air and fuel 222 is positioned to provide fuel/air mixture to both engines 220 and 221. Similarly, separate exhaust apparatus 223 and 224 are provided for each of engines 221 and 220.

Figure 13:
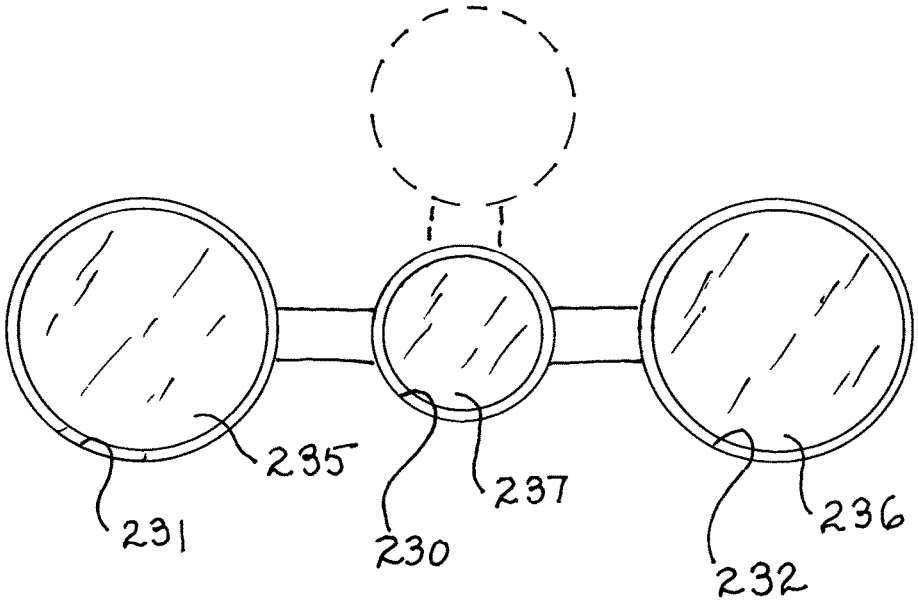
FIG. 13 sets forth a simplified operational top view diagram of a multiple compression cylinder embodiment of the present invention fuel/air induction system.

FIG. 13 provides a simplified drawing illustrating the further variation of the present invention internal combustion engine having fuel/air induction system in which a plurality of compression cylinders are provided to supply fuel/air mixture to a common combustion cylinder. While an example is shown of a pair of compression cylinders for a common combustion cylinder, it will be apparent to those skilled in the art that further variation may be provided in the ratio of compression cylinders to combustion cylinders without departing from the spirit and scope of the present invention. In FIG. 13, a pair of compression cylinders 231 and 232 having respective compression pistons 235 and 236 operative therein our coupled to a common combustion cylinder 230 having a combustion piston 237 operative therein. For purposes of illustration, an additional compression cylinder and compression piston are shown in phantom line depiction to illustrate further variation.

Figure 14:
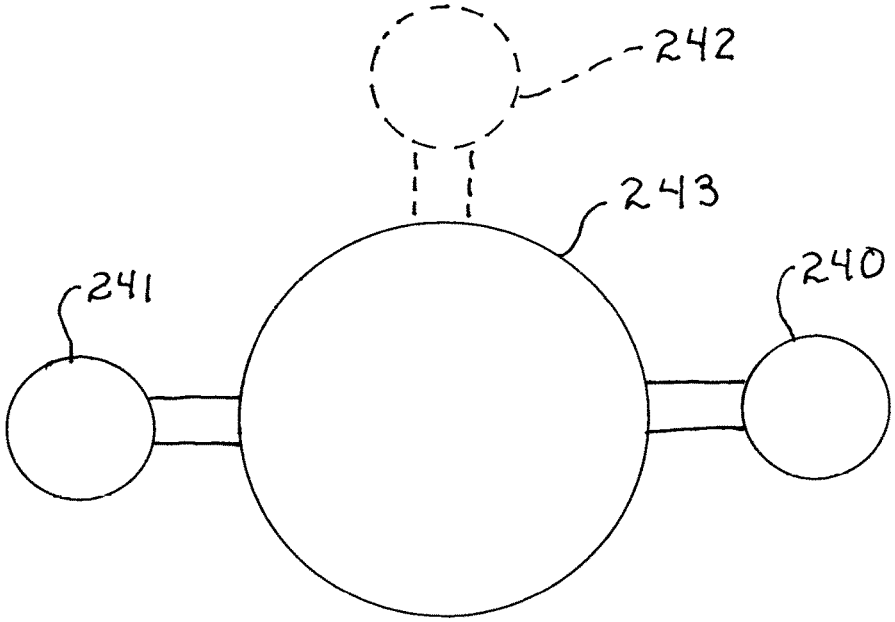
FIG. 14 sets forth a simplified operational top view diagram of a multiple cylinder embodiment of the present invention fuel/air induction system.

FIG. 14 provides a further simplified drawing illustrating the further variation of the present invention internal combustion engine having fuel/air induction system in which a plurality of combustion cylinders, 240, 241 and 242 are provided with a supply of fuel/air mixture from a common compression cylinder 243. While an example is shown of a trio of combustion cylinders fed by a common compression cylinder, it will be apparent to those skilled in the art that further variation may be provided in the ratio of compression cylinders to combustion cylinders without departing from the spirit and scope of the present invention.

What has been shown, an internal combustion engine having a fuel/air charging system that differs from previously provided internal combustion engines in that a crankshaft-driven compression piston is reciprocated within a fuel/air compression cylinder in a cooperative operation which charges a combustion cylinder with a charge of fuel/air mixture under pressure during each engine cycle. A combustion piston is reciprocated by the crankshaft within the combustion cylinder to further compress the fuel/air mixture charge and harness the power of the ignited mixture.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A two-stroke internal combustion engine comprising:

a combustion cylinder having a combustion cylinder wall defining a first inlet port and an exhaust port therein and having an igniter and a combustion piston moveable within said combustion cylinder between a top dead center and a bottom dead center position;

a compression cylinder having a compression cylinder wall defining a second inlet port and a fuel/air transfer port therein and having a compression piston moveable within said compression cylinder between a top dead center and a bottom dead center position;

a crankshaft rotatably supported and defining first and second eccentric crankshaft lobes substantially one hundred eighty crankshaft degrees out of phase with each other;

a first connecting rod connecting said combustion piston to said first crankshaft lobe;

a second connecting rod connecting said compression piston to said second crankshaft lobe;

a transfer plenum coupled between said fuel/air transfer port and said first inlet port; and a fuel/air mixture inlet coupled to said second inlet port to provide a flow of fuel/air mixture to said compression cylinder, said crankshaft rotating to move said compression piston in reciprocating motion within said compression cylinder between bottom dead center, unblocking said second inlet port and said fuel/air transfer port, and top dead center, blocking said second inlet port and compressing fuel/air, and to move said combustion piston in reciprocating motion within said combustion cylinder between bottom dead center, unblocking said first inlet port, and said exhaust port, and top dead center, blocking said first inlet port and said exhaust port compressing said fuel/air mixture in substantially opposite phase whereby said compression piston draws said fuel/air mixture from said fuel/air mixture inlet into said compression cylinder and thereafter transfers said fuel/air mixture to said combustion cylinder and wherein said igniter ignites said fuel/air mixture within said combustion cylinder in a two-stroke internal combustion operation.

2. An internal combustion two stroke engine having an engine block comprising:

a combustion cylinder, defining a combustion cylinder wall having a first inlet port and an exhaust port formed therein, said combustion cylinder being formed in said engine block having an igniter and a combustion piston moveable from bottom dead center to top dead center within said combustion cylinder blocking said first inlet port and compressing fuel/air for ignition and moveable from top dead center to bottom dead center unblocking said second inlet port and said exhaust port for power and drawing fuel/air into said combustion cylinder;

a compression cylinder, defining a compression cylinder wall having a second inlet port and a fuel/air transfer port formed therein, said compression cylinder being formed in said engine block having a compression piston moveable within said compression cylinder from top dead center to bottom dead center unblocking said second inlet port and drawing fuel/air into said compression cylinder and moveable from bottom dead center to top dead center blocking said second inlet port and compressing said fuel/air for transfer into said combustion cylinder;

a crankshaft rotatably supported upon said engine block defining first and second eccentric crankshaft lobes substantially one hundred eighty crankshaft degrees out of phase with each other;

a first connecting rod connecting said combustion piston to said first crankshaft lobe;

a second connecting rod connecting said compression piston to said second crankshaft lobe;

a transfer plenum coupled between said first inlet port of said combustion cylinder and said fuel/air transfer port of said compression cylinder; and a fuel/air mixture inlet coupled to said second inlet port to provide a flow of fuel/air mixture to said compression cylinder, said crankshaft rotating to move said compression piston in reciprocating motion within said compression cylinder and to move said combustion piston in reciprocating motion within said combustion cylinder whereby said compression piston draws said fuel/air mixture from said fuel/air mixture inlet into said compression cylinder and thereafter transfers said fuel/air mixture to said combustion cylinder and wherein said igniter ignites said fuel/air mixture within said combustion cylinder in a two-stroke internal combustion engine operation.

* * * * *